US005944583A

United States Patent [19]

Cruz et al.

[11] Patent Number: 5,944,583

[45] Date of Patent: Aug. 31, 1999

[54] COMPOSITE POLISH PAD FOR CMP

[75] Inventors: Jose Luis Cruz, Essex Junction; Steven James Messier, Williston; Douglas Keith Sturtevant; Matthew Thomas Tiersch, both of Essex Junction, all of Vt.

[73] Assignee: International Business Machines Corporation, Armonk, N.Y.

[21] Appl. No.: 08/819,466

[22] Filed: Mar. 17, 1997

[51] Int. Cl.[6] ..... B24B 1/00

[52] U.S. Cl. ..... 451/41; 451/287; 451/57

[58] Field of Search ..... 451/41, 57, 58, 451/59, 538, 539, 548, 550, 461, 278, 270, 285, 287; 175/432, 329, 374, 410

[56] References Cited

U.S. PATENT DOCUMENTS

| | | | |
|---|---|---|---|
| 794,496 | 7/1905 | Gorton | 451/529 |
| 2,309,016 | 1/1943 | Ryan | 451/461 |
| 2,451,295 | 10/1948 | Metzger et al. | 451/461 |
| 2,918,762 | 12/1959 | Hurst . | |
| 2,952,951 | 9/1960 | Simpson | 451/529 |
| 3,353,308 | 11/1967 | Zane | 451/529 |
| 3,841,031 | 10/1974 | Walsh | 451/41 |
| 4,255,165 | 3/1981 | Dennis et al. | 175/434 |
| 4,788,798 | 12/1988 | DeFranco et al. | 451/527 |
| 5,007,207 | 4/1991 | Phaal | 175/432 |
| 5,020,283 | 6/1991 | Tuttle . | |
| 5,177,908 | 1/1993 | Tuttle . | |
| 5,199,832 | 4/1993 | Meskin et al. | 451/548 |
| 5,212,910 | 5/1993 | Breivogel et al. . | |
| 5,216,843 | 6/1993 | Breivogel et al. . | |
| 5,234,867 | 8/1993 | Schultz et al. . | |
| 5,297,364 | 3/1994 | Tuttle . | |
| 5,329,734 | 7/1994 | Yu . | |
| 5,394,655 | 3/1995 | Allen et al. . | |
| 5,435,772 | 7/1995 | Yu . | |
| 5,441,598 | 8/1995 | Yu et al. . | |
| 5,454,752 | 10/1995 | Sexton et al. | 451/548 |
| 5,489,233 | 2/1996 | Cook et al. . | |
| 5,503,592 | 4/1996 | Neumann | 451/278 |
| 5,534,106 | 7/1996 | Cote et al. . | |
| 5,605,490 | 2/1997 | Laffey et al. | 451/36 |
| 5,609,517 | 3/1997 | Lofaro | 451/529 |
| 5,650,039 | 7/1997 | Talieh | 216/89 |

FOREIGN PATENT DOCUMENTS

| | | | |
|---|---|---|---|
| 602357 | 4/1978 | U.S.S.R. | 451/270 |

*Primary Examiner*—David A. Scherbel
*Assistant Examiner*—Derris Holt Banks
*Attorney, Agent, or Firm*—Schmeiser, Olsen & Watts; Howard J. Walter, Jr.

[57] ABSTRACT

A method and apparatus for polishing a semiconductor wafer using a polishing pad. Circumferential rings of alternating compressibility of hard and soft/sponge-like material are located in the polishing pad. The concentric rings may also be located off-center from the geometric center of the polishing pad.

10 Claims, 1 Drawing Sheet

COMPOSITE POLISH PAD FOR CMP

FIELD OF THE INVENTION

The invention is generally related to chemical-mechanical polish (CMP) operations performed during integrated circuit manufacturing, and particularly to polishing semiconductor wafers and chips which include integrated circuits. The invention is specifically related to polishing pad construction and operations that allow for improved control of polishing.

BACKGROUND OF THE INVENTION

Rapid progress in semiconductor device integration demands smaller and smaller wiring patterns or interconnections which connect active areas. As a result, the tolerances regarding the planeness or flatness of the semiconductor wafers used in these processes are becoming smaller and smaller. One customary way of flattening the surfaces of semiconductor wafers is to polish them with a polishing apparatus.

Such a polishing apparatus has a rotating wafer carrier assembly in contact with a polishing pad. The polishing pad is mounted on a rotating turntable which is driven by an external driving force. The polishing apparatus causes a polishing or rubbing movement between the surface of each thin semiconductor wafer and the polishing pad while dispersing a polishing slurry to obtain a chemical-mechanical polish (CMP). CMP in planarization requires the wafer surface to be brought into contact with a rotating pad saturated with either a slurry of abrasive particles or a reactive solution, or both, that attacks the wafer surface. This is done while exerting force between the wafer and polishing pad.

Generally, CMP does not uniformly polish a substrate surface and material removal proceeds unevenly. For example, it is common during oxide polishing for the edges of the wafer to be polished slower than the center of the wafer. There exists a need for a method and device for controlling the removal of material from substrate surface such as semiconductor wafers and/or chips such that a uniform surface across the substrate can be achieved.

SUMMARY OF THE INVENTION

The present invention discloses a method and apparatus for polishing a wafer with a polishing pad that includes rings of alternating compressibility.

The present invention discloses a polishing pad for polishing a semiconductor wafer comprising a flat upper surface including at least two areas of differing pad material, and wherein the areas extend in a direction across the pad in a non-radial pattern.

The present invention discloses a polishing pad for polishing a semiconductor wafer comprising concentric rings of alternating compressibility.

The present invention discloses a method for polishing a semiconductor wafer comprising providing a polishing pad with concentric rings of alternating compressibility, and polishing the semiconductor wafer.

An advantage of the present invention is that it allows a single pad to be used when polishing.

An advantage of the present invention is that it is cheaper and gives improved uniformity.

DESCRIPTION OF THE PREFERRED EMBODIMENTS

Although certain preferred embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of the embodiment.

Figure 1:
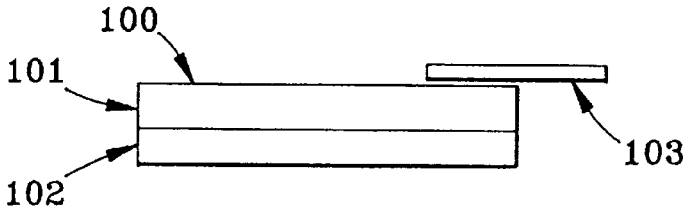
FIG. 1 PRIOR ART
FIG. 1 discloses the stacked pad configuration of the prior art.

Currently, when polishing oxide surfaces a stacked pad combination must be used to prevent various problems. FIG. 1 shows a stacked pad face 100 in contact with the wafer face 103. The use of a stacked pad is very expensive and causes outer edge oxide thickness control issues. The stacked pad is made from a soft/sponge-like pad base 102 (such as a SUBA™ 4 pad which is a polyurethane impregnated polyester felt pad) and a perforated, hard top pad 101 (such as an IC1000™ pad which is a polyurethane pad). However, a single soft/sponge-like pad cannot be used because it is very compressible and gives poor within chip uniformity and causes local dishing of structures. Also, a single hard urethane pad cannot be used because the pad is non-compressible and causes a suction seal between the wafer and pad surface. The polish tool is then unable to break this seal and the tool has unload failures. Unload failures occur when the tool cannot pull away from the the pad and, as a result, the wafer is ruined. The other reason for not being able to use a single hard polyurethane pad is that the slurry is unable to get under the wafer surface uniformly, thus the center of the wafer gets under polished. The lack of slurry under the wafer surface causes within chip, or local, non-uniformity and across wafer, or global, non-uniformity. Non-uniformity of oxide thickness across the wafer surface can cause: over and under etch, residual metal and nitride, and overall poor electrical performance.

The actual mechanism occurring with a stacked pad is that the soft/sponge-like pad and perforated, hard polyurethane pad act like a slurry reservoir. When the wafer is pressed down into the pad the soft/sponge-like pad compresses under the hard polyurethane pad and squeezes the slurry between the wafer surface and the polish surface of the hard polyurethane pad as shown in prior art FIG. 1. The problem with this is that the edge of the pad compresses more than the center of the pad, causing leading edge thickness variations. These variations lead to poor uniformity in the outer 15–20 mm of the wafer, which cause the same failure mechanism as described with a single pad. The industry is forced to live with the variations caused by single pads or the thick leading edge caused by the stacked pads. Any new type of pad improvement must address uniform slurry coverage under the wafer surface and prevent thick oxide on the leading outer edge of wafer. Also, the improvement must either eliminate the leading edge issues of the stacked pad or the local non-uniformity of the single pad.

The present invention will address these problems in polishing oxide surfaces. The present invention discloses using a single pad or stacked pads and achieving enough slurry under the wafer surface, while preventing a suction seal from forming. The idea is to use a composite pad made of a hard noncompressible pad and a soft/sponge like pad. An example of the compressible pad could be IC1000™ and the soft/sponge like pad could be SUBA™ 4. Using a hard pad provides a surface to get excellent global and local wafer uniformity, while the soft/sponge like pad traps and carries slurry under the wafer. Global uniformity is the distribution of oxide thicknesses across the whole wafer surface and local uniformity is the distribution of oxide thicknesses within the chip box. This alternating compressibility gives a pad alternating between polishing surface and slurry. Also, there are substantially no abrupt transitions across portions of the pad as it rotates to polish the semiconductor wafer.

Figure 2:
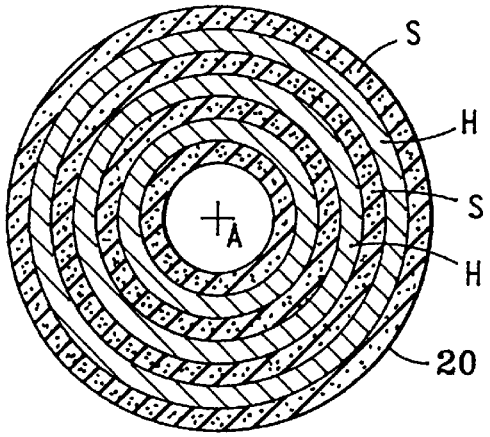
FIG. 2 discloses a top view of the present invention.
Figure 3:
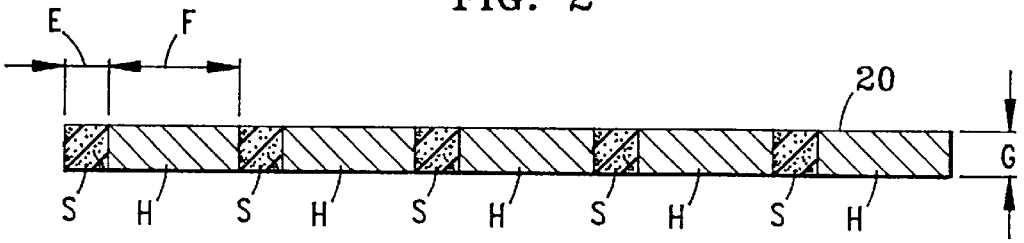
FIG. 3 discloses a cross-sectional view of the present invention.

FIGS. 2 and 3 discloses the present invention. The pad 20 which may be mounted on a platen of a polishing device (not shown), is made of alternating concentric rings of a hard non-compressible pad H and a soft/sponge like pad S. The hard and soft areas extend in a direction across the pad in a non-radial pattern. FIG. 3 shows a cross-sectional view of the polishing pad 20 which has a planar surface. The hard sections H have width F and the soft-sections S have a width E. The thickness of the polishing pad 20 is represented by G. For example purposes, when a 24 inch diameter pad is used, the thickness of the pad G was approximately 0.05 to 0.055 inches, the hard section width F approximately ¾ inches, and the soft/sponge-like section E has a width ranging from ⅛ to ¼ inches.

Figure 4:
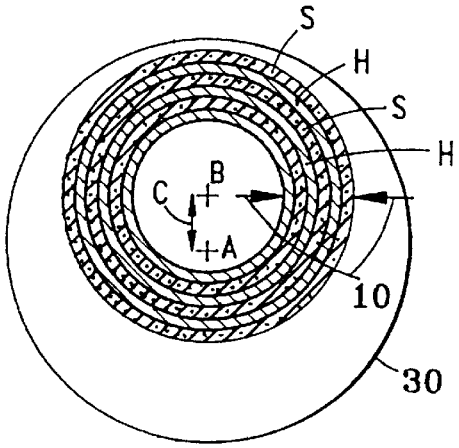
FIG. 4 discloses an alternative embodiment of the present invention.

FIG. 4 shows an alternative embodiment of the present invention. The polishing pad 30 has the concentric rings with alternating compressibility off-center with respect to the geometric center of the polishing pad 30. The alternating concentric rings are centered at point B instead of at the geometric center of the pad point A. The alternating rings path area 10 is designed so that only full concentric rings are used to prevent any imprinting into the wafer surface. The area of the pad outside the alternating rings path area may be constructed of a hard material such as the IC1000™. The off-center distance represented by C may range, for example, from 1.5 inches to 4 inches.

The use of a composite pad with alternating compressibility provides consistent and uniform coverage of slurry under the entire wafer surface, while providing a porous surface that prevents a suction seal. Since a single pad may be used, it completely eliminates leading edge thickness variations. Overall uniformity is two to three times better than the current stacked pad configuration. Thus the idea provides a mechanism that will meet product specifications and eliminate both local and global non-uniformity issues.

The composite pad of the present invention can be used to polish one semiconductor wafer at a time or to polish a plurality of semiconductor wafers at the same time.

Another advantage of the present invention is that materials from different portions of the substrate can be removed at different rates to obtain a more uniform surface across the substrate.

Another advantage of the present invention is the ability to run a single pad because the soft rings are made of a soft/sponge-like material that will give the slurry the ability to soak into these areas. Therefore there is a constant slurry supply or a slurry transport system underneath the face of the wafer in the soft/sponge-like area and the harder material is where polishing is done. Therefore, the present invention allows for a single polishing pad process or a stacked pad polishing process.

Another advantage of the present invention is that it eliminates a phenomena called "wafer stickage" where cohesive forces between the face of the wafer and the actual smooth polishing pad form a suction. When suction is created it is very difficult to pull the wafer off the face. The alternating rings provide a release so that the wafer can lift back off the polishing surface. Therefore, the wafer does not get stuck because a little air is being let into the seal. By being able to run with a single pad it results in a cheaper polishing operation.

Another advantage of the present invention is that both global uniformity and local uniformity of polishing is achieved.

The examples provided above are used for illustrative purposes and it should be understood that different combinations of polishing pad, slurry, polishing carrier, and table size can be used depending on the film which is to be removed, the thickness profile prior to polishing and the desired final profile.

While the invention has been described in terms of its preferred embodiments, those skilled in the art will recognize that the invention can be practiced with modification within the spirit and scope of the appended claims.

What is claimed is:

1. A single layer polishing pad for polishing a semiconductor wafer comprising:

a single layer including a first area made of non-compressible material and a second area made of a compressible material, each area extending the thickness of the polishing pad.

2. The polishing pad of claim 1, wherein there are substantially no abrupt transitions across portions of the pad as it rotates to polish the semiconductor wafer.

3. A polishing pad for polishing semiconductor wafers comprising:

a single layer of concentric rings of alternating compressibility and uniform thickness.

4. The polishing pad of claim 3, wherein the concentric rings of alternating compressibility include hard rings and soft rings.

5. The polishing pad of claim 3, wherein the width of the hard rings is ¾ inches and the width of the soft rings ranges from ⅛ to ¼ inches.

6. The polishing pad of claim 3, wherein the concentric rings of alternating compressibility include polyurethane rings and polyurethane impregnated polyester felt rings.

7. A pad for polishing a semiconductor wafer comprising:

concentric rings of alternating compressibility having a geometric center and extending in a generally circumferential direction, said concentric rings extending the thickness of the pad; and wherein said geometric center is off-center with a center of the polishing pad.

8. The polishing pad of claim 7, wherein the geometric center is off-center from the center of the polishing pad in the range of 1.5 to 4 inches.

9. A method for polishing a semiconductor wafer comprising:

providing a single layer polishing pad having a first surface for mounting to a platen of a polishing device, and a second surface for polishing a semiconductor wafer, and including a first area made of a non-compressible material and a second area made of a compressible material; and polishing a semiconductor wafer while constantly maintaining slurry underneath a wafer.

10. A method for polishing a semiconductor wafer comprising:

providing a polishing pad with concentric rings of alternating compressibility and uniform thickness, said concentric rings extending the thickness of the pad; and polishing the semiconductor wafer.

* * * * *